US011325240B2

(12) United States Patent
Mostafa

(10) Patent No.: US 11,325,240 B2
(45) Date of Patent: May 10, 2022

(54) ERGONOMIC TOOL

(71) Applicant: Talaat H. A. Mostafa, Edmonton (CA)

(72) Inventor: Talaat H. A. Mostafa, Edmonton (CA)

( * ) Notice: Subject to any disclaimer, the term of this patent is extended or adjusted under 35 U.S.C. 154(b) by 276 days.

(21) Appl. No.: 16/333,557

(22) PCT Filed: Sep. 14, 2016

(86) PCT No.: PCT/CA2016/051082
§ 371 (c)(1),
(2) Date: Mar. 14, 2019

(87) PCT Pub. No.: WO2018/049502
PCT Pub. Date: Mar. 22, 2018

(65) Prior Publication Data
US 2019/0255694 A1 Aug. 22, 2019

(51) Int. Cl.

| | |
|---|---|
| ***B25G 1/02*** | (2006.01) |
| ***B25D 1/14*** | (2006.01) |
| ***B25G 1/10*** | (2006.01) |
| ***B25G 3/26*** | (2006.01) |
| ***B25D 1/02*** | (2006.01) |
| ***B25G 1/01*** | (2006.01) |

(52) U.S. Cl.
CPC ..... *B25G 1/02* (2013.01); *B25D 1/02* (2013.01); *B25D 1/14* (2013.01); *B25G 1/01* (2013.01); *B25G 1/102* (2013.01); *B25G 3/26* (2013.01); *B25D 2222/45* (2013.01)

(58) Field of Classification Search
CPC . B25G 1/02; B25G 1/01; B25G 1/102; B25G 3/26; B25G 1/10; B25D 1/02; B25D 1/14; B25D 2222/45; B25D 1/12; B25D 1/00
See application file for complete search history.

(56) References Cited

U.S. PATENT DOCUMENTS

| | | | | |
|---|---|---|---|---|
| X50262 | | 10/1865 | Monson | |
| X271303 | | 1/1883 | Blaker | |
| X531882 | | 1/1895 | Stewart | |
| X861659 | | 7/1907 | Johnston | |
| 1,515,708 | A * | 11/1924 | Stolle | B25G 3/28 254/26 R |
| 2,539,229 | A | 12/1947 | Colburn | |
| 2,809,684 | A | 11/1955 | Lyon | |
| 3,821,973 | A * | 7/1974 | Carmien | B25D 1/02 81/25 |

(Continued)

FOREIGN PATENT DOCUMENTS

| | | |
|---|---|---|
| GB | 2053771 | 2/1981 |
| SE | 507631 | 6/1998 |

OTHER PUBLICATIONS

International Search Report issued on related application PCT/CA2016/05182, 5 pages.

*Primary Examiner* — Robert J Scruggs
(74) *Attorney, Agent, or Firm* — Robert A. Nissen

(57) ABSTRACT

A tool including a handle, a head, and a flexible shaft including a plurality of shaft members each connecting the handle with the head. The shaft members include at least one fixed shaft member and at least one floating shaft member. Each of the fixed shaft members is fixedly connected with both the handle and the head, and each of the floating shaft members is reciprocably connected with at least one of the handle and the head.

21 Claims, 6 Drawing Sheets

(56) References Cited

U.S. PATENT DOCUMENTS

| | | | | | |
|---|---|---|---|---|---|
| 4,266,588 | A * | 5/1981 | Tudisco | B25G 1/01 | 81/22 |
| 4,331,193 | A * | 5/1982 | Tudisco | B25G 1/01 | 81/22 |
| 4,633,741 | A * | 1/1987 | Yang | B25G 1/01 | 81/19 |
| 5,029,496 | A | 7/1991 | Catania | | |
| 5,099,724 | A * | 3/1992 | Reddy, Jr. | B25G 1/04 | 81/177.2 |
| 5,261,164 | A | 11/1993 | Bellegante | | |
| 5,280,739 | A * | 1/1994 | Liou | B25G 3/02 | 81/22 |
| 5,941,139 | A * | 8/1999 | Vodehnal | B25B 17/00 | 81/57.43 |
| 6,477,922 | B1 * | 11/2002 | Burnett | B25D 1/00 | 81/20 |
| 6,536,308 | B1 * | 3/2003 | Thorne | B25D 1/02 | 81/20 |
| 6,625,848 | B1 | 9/2003 | Schneider | | |
| 6,739,218 | B2 | 5/2004 | Tang | | |
| 7,272,995 | B1 * | 9/2007 | Mavin | B25G 1/04 | 81/20 |
| 7,665,390 | B2 | 2/2010 | Hoffman | | |
| 2006/0288530 | A1 * | 12/2006 | McCauley | A46B 5/0062 | 16/110.1 |
| 2013/0126808 | A1 * | 5/2013 | Lombardi | B25G 1/10 | 254/26 R |

* cited by examiner

ERGONOMIC TOOL

TECHNICAL FIELD

A tool for providing ergonomic benefits to a user.

BACKGROUND OF THE INVENTION

Many types of tools are used by both tradesmen and laymen, such as tools which are operated by swinging including, but not limited to, hammers, batons, meat tenderizers, and throwing devices. Such tools commonly comprise a handle, a head, and a shaft connecting the handle with the head. Oftentimes, these tools require a significant swing or input force to use, and may transmit significant mechanical shock to the user.

As a result, using such tools is often difficult for users who are unable to provide a sufficient swing or input force, such as elderly users or users with disabilities. Further, when used regularly such tools can be dangerous, as repeated transmission of mechanical shock through the user's arm can lead to injury.

Various attempts have been made in the prior art to overcome these difficulties. Examples of such attempts are described in U.K. Patent No. 2,053,771 (Whiteford), Swedish Patent No. 507,631 (Bergling), U.S. Pat. No. 50,262 (Monson), U.S. Pat. No. 271,303 (Blaker), U.S. Pat. No. 531,882 (Stewart), U.S. Pat. No. 861,659 (Johnston), U.S. Pat. No. 2,539,229 (Colburn), U.S. Pat. No. 2,809,684 (Lyon), U.S. Pat. No. 4,266,588 (Tudisco), U.S. Pat. No. 4,633,741 (Yang), U.S. Pat. No. 5,029,496 (Catania), U.S. Pat. No. 5,261,164 (Bellegante), U.S. Pat. No. 6,625,848 (Schneider), U.S. Pat. No. 6,739,218 (Yang), and U.S. Pat. No. 7,665,390 (Hoffman).

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a tool comprising a handle, a head, and a shaft comprised of a plurality of shaft members connecting the handle with the head, wherein the shaft members are flexible in order to provide ergonomic benefits to a user. The tool may be any tool manually operated by swinging. As non-limiting examples, the tool may be a hammer, a baton, a meat tenderizer, a throwing device, etc. The ergonomic benefits may include ease of use, reduced stress on the user, and reduced swing or input force required.

In an exemplary aspect, the invention is a tool comprising:

(a) a handle;

(b) a head; and (c) a flexible shaft comprising a plurality of flexible shaft members each connecting the handle with the head, wherein the plurality of flexible shaft members comprises at least one fixed shaft member and at least one floating shaft member, wherein each of the fixed shaft members is fixedly connected with both the handle and the head, and wherein each of the floating shaft members is reciprocably connected with at least one of the handle and the head.

In some embodiments, a floating shaft member may be reciprocably connected with one of the handle or the head and may be fixedly connected with the other of the handle and the head. In some embodiments, a floating shaft member may be reciprocably connected with both the handle and the head.

In some embodiments the head may comprise a tool structure. In some embodiments, the tool structure may comprise a striking face. Therefore, the head may be comprised of any material or combination of materials having properties which are suitable to enable the head to perform its tool function. As non-limiting examples, depending upon the type of tool, the head may be comprised of suitable metal, wood, plastic, or composite materials. Further, as non-limiting examples, a suitable metal may be titanium, steel, or copper. In some embodiments the striking face may be oblique to a longitudinal tool axis, to accommodate the bending of the shaft such that the striking face strikes its target directly. Oblique refers to having any angle which is not 0, 90, or 180 degrees.

In some embodiments the head may comprise a single head component. In other embodiments the head may comprise a plurality of head components. In some embodiments the head components may be inseparable. In other embodiments the head components may be separable.

In some embodiments in which the head comprises two head components, the head components may be a first head component and a second head component.

In some embodiments in which the head comprises two head components, each head component may comprise a tool structure. In some embodiments, at least one of the tool structures may comprise a striking face. In some embodiments, at least one striking face may be oblique to the longitudinal tool axis.

In some embodiments in which the head comprises a plurality of head components, there may be a connection mechanism for connecting the head components with each other. The connection mechanism may be any suitable mechanism or combination of mechanisms. In some embodiments in which there are two head components, the connection mechanism may connect the first head component and the second head component along a longitudinal interface. In some embodiments, the longitudinal interface may be perpendicular to a tool swinging plane. In some embodiments, the longitudinal interface may be offset from the longitudinal tool axis, resulting in an unequal weighting of the head components that may provide different advantages to each head component for different applications. In some embodiments, the tool may be symmetric about the longitudinal tool axis in a tool swinging plane in order to increase the user's accuracy.

For inseparable head components the connection mechanism may comprise, consist of, or consist essentially of any suitable permanent mechanism such as a weld, a rivet, a nail, or glue, as non-limiting examples, and may additionally comprise any suitable nonpermanent mechanism. For separable head components the connection mechanism may comprise, consist of, or consist essentially of any suitable nonpermanent mechanism such as a screw, a bolt, a peg, or a tie, as non-limiting examples.

In some embodiments in which the head comprises two head components, one of the head components may define a locating hole and the other of the head components may comprise a locating post to assist in guiding the head components together in a correct position to allow for assembly, and the connection mechanism may comprise the locating hole and the locating post.

In some embodiments in which the head comprises two head components, one of the head components may comprise a protrusion and the other of the head components may define a cavity wherein the protrusion is receivable within the cavity, and the connection mechanism may comprise the protrusion and the cavity. In some embodiments in which the cavity and the protrusion are defined along the longitudinal interface, the longitudinal tool axis may intersect both the cavity and the protrusion.

In some embodiments in which the head comprises two head components, each of the head components may comprise one or more connecting flanges, wherein the connecting flanges interlock to connect the head components, and the connection mechanism may comprise the connecting flanges. In some embodiments in which the connection mechanism comprises a protrusion and a cavity, the flanges may be associated with and/or may be provided by the protrusion and the cavity. In some embodiments in which the connection mechanism comprises a protrusion and a cavity, the flanges may be separate from and/or independent from the protrusion and the cavity.

In some embodiments, the connection mechanism may comprise a plurality of mechanisms, including as non-limiting examples, the locating hole and the locating post, the protrusion and the cavity, and/or the connecting flanges.

In some embodiments, the tool may further comprise a retainer for maintaining a connected configuration of the head components. The retainer may comprise any suitable device or mechanism including, as non-limiting examples, a band or a cover. The retainer may permanently maintain the connected configuration of the head components or may nonpermanently maintain the connected configuration of the head components.

In some embodiments, the head may receive the shaft members within a longitudinal opening or a plurality of longitudinal openings defined in the head. The opening, or plurality of openings, may take any suitable shape for receiving the shaft members including, as non-limiting examples, cylindrical or prismatic. In some embodiments the opening, or plurality of openings, may extend longitudinally partially through the head. In other embodiments the opening, or plurality of openings, may extend longitudinally entirely through the head.

In embodiments in which the head comprises a plurality of head components, one or more of the head components may define a longitudinal opening or a plurality of longitudinal openings for receiving the shaft members. In some embodiments, each of the head components may define at least one longitudinal opening.

In some embodiments, the tool may further comprise a head fastening system for connecting the head with the shaft members. The head fastening system may be or may comprise any system or combination of systems which is suitable for connecting the head with the fixed shaft members and the floating shaft members.

In some embodiments the head fastening system may provide a permanent connection between the head and the shaft members. In other embodiments the head fastening system may provide a nonpermanent connection between the head and the shaft members. In some embodiments, the head fastening system may provide a plurality of fastening positions of the head relative to the shaft members along the longitudinal tool axis in order to vary a longitudinal head position of the head relative to the shaft members.

For permanent connections the head fastening system may comprise, consist of, or consist essentially of one or more suitable devices or mechanisms for providing a permanent connection such as a weld, a rivet, a nail, or glue, as non-limiting examples, and may additionally comprise one or more suitable devices or mechanisms for providing a nonpermanent connection to supplement the permanent connection. In some embodiments, the head may be integral with the shaft members in order to provide a permanent connection between the head and the shaft members.

For nonpermanent connections the head fastening system may comprise, consist of, or consist essentially of one or more suitable devices or mechanisms for providing a nonpermanent connection such as a screw, a bolt, a peg, or a tie, as non-limiting examples.

In some embodiments, the head fastening system may comprise a slot defined in at least one shaft member, a bore defined in the head, and a pin for inserting in the bore and engaging the slot. In some embodiments in which the shaft members are receivable within a longitudinal opening or a plurality of longitudinal openings in the head, the bore may intersect at least one of the longitudinal openings in order to allow the pin to engage the slot in at least one shaft member.

The slot, the bore, and the pin may be provided in any shapes and/or configurations which are suitable for enabling the slot, the bore, and the pin to cooperate to provide the connection between the head and the shaft members. As non-limiting examples, the slot, the bore, and the pin may have complementary circular, oval, or polygonal cross-sections.

The pin may comprise a suitable fastener including, as non-limiting examples, a screw, a bolt, or a peg. Further, in some embodiments in which the bore extends entirely through the head, the head fastening system may further comprise a mating fastener, such as a nut, as a non-limiting example. In some embodiments, the slot and/or the bore may be threaded.

In some embodiments, the shaft members may define a plurality of slots at different longitudinal slot positions along a longitudinal shaft axis. In some embodiments, the head may define a plurality of bores at different longitudinal bore positions along a longitudinal head axis. In some embodiments in which the head fastening system comprises a plurality of slots and a plurality of bores, the head fastening system may further comprise a plurality of pins in order to increase the strength of the head fastening system. Further, in some embodiments, at least one pin may engage at least one slot defined by the fixed shaft members, and may not engage any slots defined by the floating shaft members.

In some embodiments, the head fastening system may further comprise at least one elongated slot defined in the floating shaft members. Therefore, in some embodiments, at least one pin may engage at least one slot defined in a fixed shaft member to fixedly connect the head with the fixed shaft member and at least one elongated slot defined in a floating shaft member to reciprocably connect the head with the floating shaft member. Engaging at least one elongated slot in a floating shaft member provides a more secure connection between the head and the floating shaft member while still allowing for a reciprocable connection.

In embodiments in which the head comprises a plurality of head components, one or more of the head components may define a bore or a plurality of bores for receiving a pin. In some embodiments, each of the head components may define at least one bore.

In some embodiments in which shaft comprises a plurality of shaft members, each shaft member may be either a fixed shaft member or a floating shaft member. The fixed shaft members are fixedly connected with both the handle and the head. The floating shaft members are reciprocably connected with at least one of the handle and the head. Fixedly connected refers to the shaft member not being capable of any significant translational motion with respect to the handle and/or the head. Reciprocably connected refers to the shaft member being capable of translational motion with respect to the handle and/or the head along the longitudinal tool axis. The floating shaft members increase the overall strength of the shaft without significantly decreasing the flexibility of the shaft. In some embodiments in which there are two shaft members, the shaft members may be a first shaft member and a second shaft member.

The shaft members may take any shape suitable for performing their functions including, as non-limiting examples, cylindrical or prismatic. The shaft members may achieve flexibility by any suitable means or combination of means including a material property, such as a relatively low elastic modulus, and/or a shape property, such as length and/or cross-section, as non-limiting examples.

In some embodiments, the shaft members may be flexible only in a tool swinging plane in order to prevent the tool from bending off-center of its target, thereby increasing the user's accuracy. As non-limiting examples, flexibility in the shaft members may be limited to only one plane by a material property, such as orthotropy, wherein the material properties vary with orientation, and/or a shape property, such as cross-section, as non-limiting examples.

In some embodiments, the shaft members may comprise a resilient material in order to achieve flexibility, wherein the resilient material can be bent with relative ease and springs back to its original shape after deformation. As non-limiting examples, the resilient material may be any suitable plastic, metal, wood, or rubber. Further, as non-limiting examples, a suitable metal may be spring steel or aluminum.

In some embodiments the resilient material may be provided as a plurality of resilient material segments. In other embodiments the resilient material may be provided as a single piece of resilient material. In some embodiments only a portion of a shaft member may be constructed of the resilient material. In other embodiments an entire shaft member may be constructed substantially of the resilient material so that the shaft member consists or consists essentially of the resilient material. Further, the shaft may be any suitable length that allows it to achieve the required deformation and return to equilibrium given its flexibility, the weight of the head, and the function of the tool.

The shaft has an amount of flexibility, which in some embodiments may be variable. In some embodiments the amount of flexibility may be changed by varying the position of the head and/or the handle relative to the shaft members along the longitudinal tool axis, known as the longitudinal head position and a longitudinal handle position respectively.

In some embodiments the handle may comprise a single handle component. In other embodiments the handle may comprise a plurality of handle components. In some embodiments the handle components may be inseparable. In other embodiments the handle components may be separable.

The handle may take any shape suitable for performing its function including, as non-limiting examples, spherical, cylindrical, or prismatic. In some embodiments, the handle may further comprise a gripping surface in order to reduce chances of the tool slipping in the user's hand. The gripping surface may perform this function by any suitable means including, as non-limiting examples, comprising a contoured surface for receiving the user's hand or comprising a slip-resistant material.

In some embodiments in which the handle comprises two handle components, the handle components may be a first handle component and a second handle component.

In some embodiments in which the handle comprises a plurality of handle components, there may be a connection mechanism for connecting the handle components with each other. The connection mechanism may be any suitable mechanism or combination of mechanisms.

For inseparable handle components the connection mechanism may comprise, consist of, or consist essentially of any suitable permanent mechanism such as a weld, a rivet, a nail, or glue, as non-limiting examples, and may additionally comprise any suitable nonpermanent mechanism. For separable handle components the connection mechanism may comprise, consist of, or consist essentially of any suitable nonpermanent mechanism such as a screw, a bolt, a peg, or a tie, as non-limiting examples.

In some embodiments in which the handle comprises two handle components, one of the handle components may define a locating hole and the other of the handle components may comprise a locating post to assist in guiding the handle components together in a correct position to allow for assembly, and the connection mechanism may comprise the locating hole and the locating post.

In some embodiments in which the handle comprises two handle components, one of the handle components may comprise a protrusion and the other of the handle components may define a cavity wherein the protrusion is receivable within the cavity, and the connection mechanism may comprise the protrusion and the cavity.

In some embodiments in which the handle comprises two handle components, each of the handle components may comprise one or more connecting flanges, wherein the connecting flanges interlock to connect the handle components, and the connection mechanism may comprise the connecting flanges. In some embodiments in which the connection mechanism comprises a protrusion and a cavity, the flanges may be associated with and/or may be provided by the protrusion and the cavity. In some embodiments in which the connection mechanism comprises a protrusion and a cavity, the flanges may be separate from and/or independent from the protrusion and the cavity.

In some embodiments, the connection mechanism may comprise a plurality of mechanisms, including as non-limiting examples, the locating hole and the locating post, the protrusion and the cavity, and/or the connecting flanges.

In some embodiments, the tool may further comprise a retainer for maintaining a connected configuration of the handle components. The retainer may comprise any suitable device or mechanism including, as non-limiting examples, a band or a cover. The retainer may permanently maintain the connected configuration of the handle components or may nonpermanently maintain the connected configuration of the handle components.

In some embodiments, the handle may receive the shaft members within a longitudinal opening or a plurality of longitudinal openings. The opening, or plurality of openings, may take any suitable shape for receiving the shaft members including, as non-limiting examples, cylindrical or prismatic. In some embodiments the opening, or plurality of openings, may extend longitudinally partially through the handle. In other embodiments the opening, or plurality of openings, may extend longitudinally entirely through the handle.

In embodiments in which the handle comprises a plurality of handle components, one or more of the handle components may define a longitudinal opening or a plurality of longitudinal openings for receiving the shaft members. In some embodiments, each of the handle components may define at least one longitudinal opening.

In some embodiments, the tool may further comprise a handle fastening system for connecting the handle with the shaft members. The handle fastening system may be or may comprise any system or combination of systems which is suitable for connecting the handle with the fixed shaft members and the floating shaft members.

In some embodiments the handle fastening system may provide a permanent connection between the handle and the shaft members. In other embodiments the handle fastening system may provide a nonpermanent connection between the handle and the shaft members. In some embodiments, the handle fastening system may provide a plurality of fastening positions of the handle relative to the shaft members along the longitudinal tool axis in order to vary a longitudinal head position of the handle relative to the shaft members.

For permanent connections the handle fastening system may comprise, consist of, or consist essentially of one or more suitable devices or mechanisms for providing a permanent connection such as a weld, a rivet, a nail, or glue, as non-limiting examples, and may additionally comprise one or more suitable devices or mechanisms for providing a nonpermanent connection to supplement the permanent connection. In some embodiments, the handle may be integral with the shaft members in order to provide a permanent connection between the handle and the shaft members.

For nonpermanent connections the handle fastening system may comprise, consist of, or consist essentially of one or more suitable devices or mechanisms for providing a nonpermanent connection such as a screw, a bolt, a peg, or a tie, as non-limiting examples.

In some embodiments, the handle fastening system may comprise a slot defined in at least one shaft member, a bore defined in the handle, and a pin for inserting in the bore and engaging the slot. In some embodiments in which the shaft members are receivable within a longitudinal opening or a plurality of longitudinal openings in the handle, the bore may intersect at least one of the longitudinal openings in order to allow the pin to engage the slot in at least one shaft member.

The slot, the bore, and the pin may be provided in any shapes and/or configurations which are suitable for enabling the slot, the bore, and the pin to cooperate to provide the connection between the handle and the shaft members. As non-limiting examples, the slot, the bore, and the pin may have complementary circular, oval, or polygonal cross-sections.

The pin may comprise a suitable fastener including, as non-limiting examples, a screw, a bolt, or a peg. Further, in some embodiments in which the bore extends entirely through the handle, the handle fastening system may further comprise a mating fastener, such as a nut, as a non-limiting example. In some embodiments, the slot and/or the bore may be threaded.

In some embodiments, the shaft members may define a plurality of slots at different longitudinal slot positions along a longitudinal shaft axis. In some embodiments, the handle may define a plurality of bores at different longitudinal bore positions along a longitudinal handle axis. In some embodiments in which the handle fastening system comprises a plurality of slots and a plurality of bores, the handle fastening system may further comprise a plurality of pins in order to increase the strength of the handle fastening system. Further, in some embodiments, at least one pin may engage at least one slot defined by the fixed shaft members, and may not engage any slots defined by the floating shaft members.

In some embodiments, the handle fastening system may further comprise at least one elongated slot defined in the floating shaft members. Therefore, in some embodiments, at least one pin may engage at least one slot defined in a fixed shaft member to fixedly connect the handle with the fixed shaft member and at least one elongated slot defined in a floating shaft member to reciprocably connect the handle with the floating shaft member. Engaging at least one elongated slot in a floating shaft member provides a more secure connection between the handle and the floating shaft member while still allowing for a reciprocable connection.

In embodiments in which the handle comprises a plurality of handle components, one or more of the handle components may define a bore or a plurality of bores for receiving a pin. In some embodiments, each of the handle components may define at least one bore.

In some embodiments in which the tool comprises two shaft members and two head components, the tool may be separable into two sub-tools each comprising one of the head components so that the sub-tools may be usable independently, wherein the sub-tools are a first sub-tool and a second sub-tool. The first sub-tool may comprise the first shaft member fixedly connected to the first head component, and the second sub-tool may comprise the second shaft member fixedly connected to the second head component. In some embodiments, separation of the tool into sub-tools may be achieved by removing the handle from the shaft members and separating the head components.

In some embodiments either sub-tool may further comprise the handle, which may be connected to the shaft member of the sub-tool using the handle fastening system. In some embodiments in which the handle comprises a plurality of handle components, each sub-tool may comprise a handle component, which may be connected to the shaft member of the sub-tools using the handle fastening system.

BRIEF DESCRIPTION OF DRAWINGS

Embodiments of the invention will now be described with reference to the accompanying drawings, in which.

DETAILED DESCRIPTION

The present invention is directed at a tool for providing ergonomic benefits to a user. A non-limiting exemplary embodiment of the tool is depicted in FIGS. 1-13.

Figure 1:
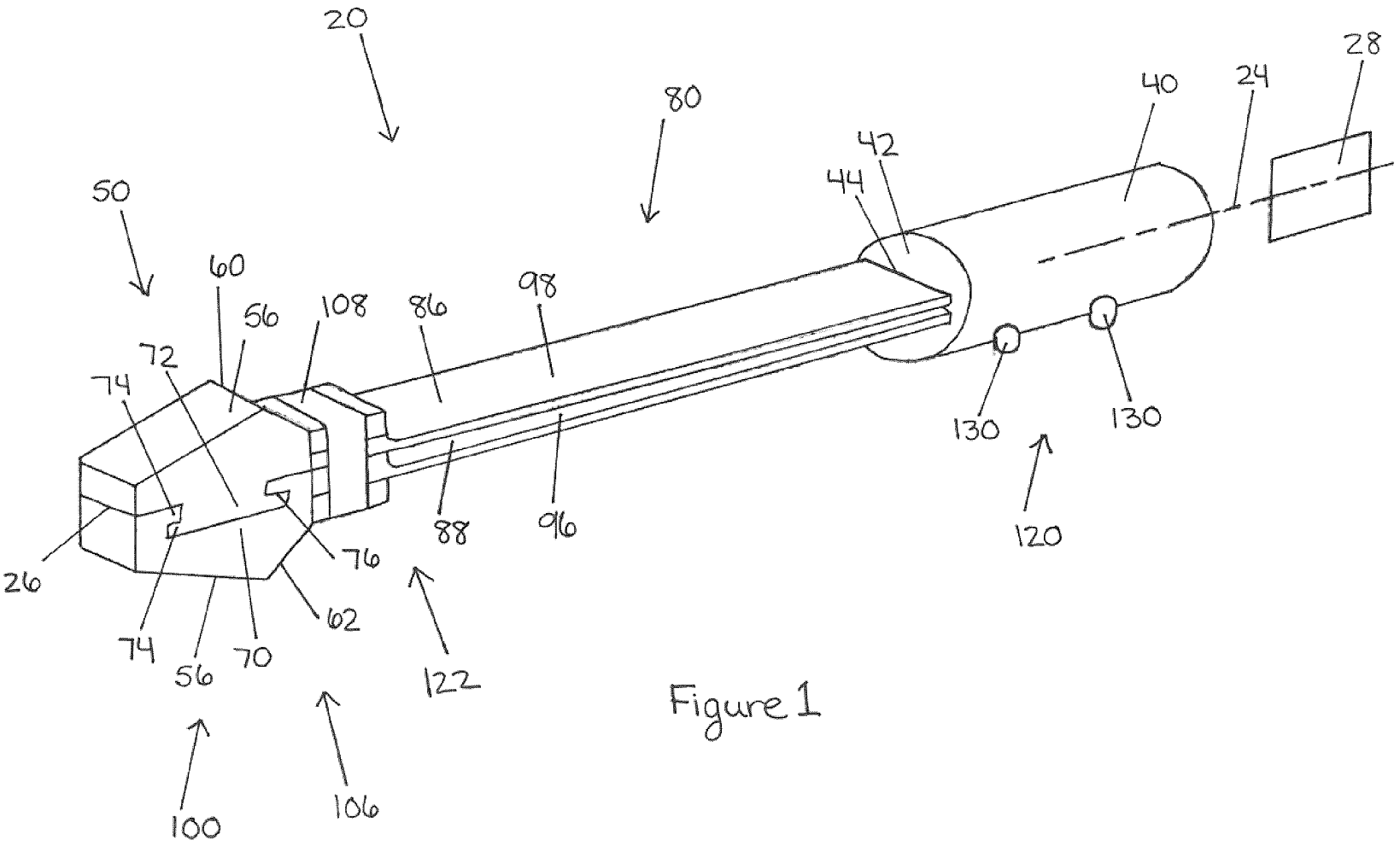
FIG. 1 is a pictorial view of the exemplary embodiment of a tool.

Referring to FIG. 1, in the exemplary embodiment the tool (20) is a hammer comprising a handle (40), a head (50), and a shaft (80) connecting the handle (40) with the head (50), wherein the shaft (80) comprises a plurality of flexible shaft members (86, 88).

In the exemplary embodiment, the handle (40) comprises a single handle component.

In the exemplary embodiment the head (50) comprises two separable head components: a first head component (60) and a second head component (62). In the exemplary embodiment, each head component (60, 62) comprises a tool structure, and each tool structure comprises a striking face (56). In the exemplary embodiment, each striking face (56) is also oblique to a longitudinal tool axis (24) to accommodate the bending of the shaft (80) such that the striking face (56) strikes its target directly. However, the striking faces (56) are at different angles relative to the longitudinal tool axis (24) in order to provide different advantages to the head components (60, 62) for different applications. The head components (60, 62) may comprise any suitable material. In the exemplary embodiment, the suitable material is titanium.

The two separable head components (60, 62) are connected by a connection mechanism (100). The connection mechanism (100) connects the two head components (60, 62) along a longitudinal interface (26), wherein the longitudinal interface (26) is perpendicular to a tool swinging plane (28). In the exemplary embodiment, the longitudinal interface (26) is offset from the longitudinal tool axis (24) due to the asymmetric size and shape of the head components (60, 62). The head components (60, 62) are asymmetrical as a result of the connection mechanism (100), wherein the head components (60, 62) are shaped to accommodate and receive one another. The unequal size of the two head components (60, 62) makes one of the head components (60, 62) more suitable to light hammering applications and the other of the head components (60, 62) more suitable to heavy hammering applications. In the tool swinging plane (28) the tool (20) is substantially symmetrical about the longitudinal tool axis (24) in order to increase the user's accuracy when swinging the tool (20).

In the exemplary embodiment, the first head component (60) defines a locating hole (112) and the second head component (62) comprises a locating post (114), and the connection mechanism (100) comprises the locating hole (112) and the locating post (114). The locating post (114) is receivable within the locating hole (112) to assist in guiding the head components (60, 62) together in a correct position to allow for assembly.

Further, in the exemplary embodiment the first head component (60) comprises a protrusion (72) along the longitudinal interface (26) and the second head component (62) defines a cavity (70) along the longitudinal interface (26), and the connection mechanism (100) further comprises the protrusion (72) and the cavity (70). The protrusion (72) is receivable within the cavity (70) such that the longitudinal tool axis (24) intersects both the cavity (70) and the protrusion (72). The second head component (62) is larger than the first head component (60) in order to compensate for the loss of material defining the cavity (70) and thereby increase the structural integrity of the second head component (62).

Finally, in the exemplary embodiment each of the head components (60, 62) comprises two connecting flanges (74), and the connection mechanism (100) further comprises the connecting flanges (74). The connecting flanges (74) interlock (76) to connect the head components (60, 62).

In the exemplary embodiment, the tool (20) further comprises a retainer. The retainer maintains a connected configuration (106) of the head components (60, 62). In the exemplary embodiment, the retainer comprises a band (108) such as an elastic band that surrounds the head components (60, 62).

In the exemplary embodiment, connecting the head components (60, 62) comprises placing the locating post (114) within the locating hole (112) while the head components (60, 62) are at a right angle to one another. The head components (60, 62) are then rotated about the locating post (114) and the locating hole (112) until the protrusion (72) is fully received within the cavity (70) and the connecting flanges (74) interlock (76), aligning the head components (60, 62) with one another to form a connected configuration (106) of the head components (60, 62). The band (108) is then placed around the head components (60, 62) to maintain the connected configuration (106) of the head components (60, 62).

In the exemplary embodiment, the tool (20) further comprises a head fastening system (122) for connecting the head components (60, 62) with the shaft members (86, 88). The head fastening system (122) may connect a head component (60, 62) with a shaft member (86, 88) fixedly or reciprocably, and permanently or nonpermanently.

In the exemplary embodiment, each of the head components (60, 62) is fixedly and permanently connected with one of the shaft members (86, 88) by welding so that the head fastening system (122) comprises welds between the head components (60, 62) and the shaft members (86, 88). In other embodiments, one of the head components (60, 62) may be reciprocably connected with one of the shaft members (86, 88), and/or one or both of the head components (60, 62) may be nonpermanently connected with a shaft member (86, 88). In other embodiments, one or both of the head components (60, 62) may be integrally formed with a shaft member (86, 88).

Figure 2:
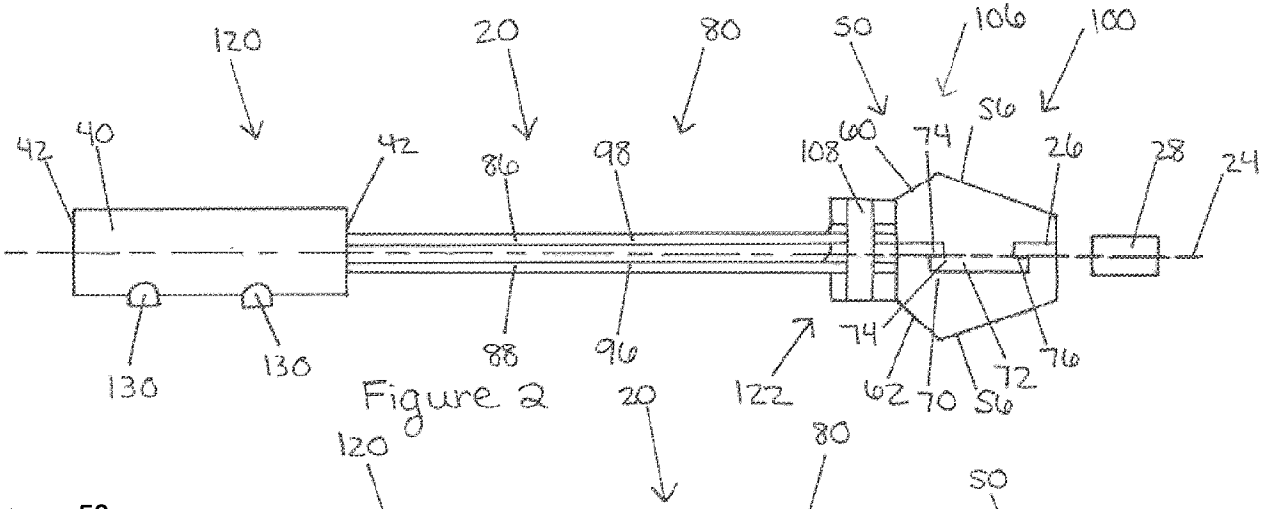
FIG. 2 is a side view of the exemplary embodiment of the tool.
Figure 3:
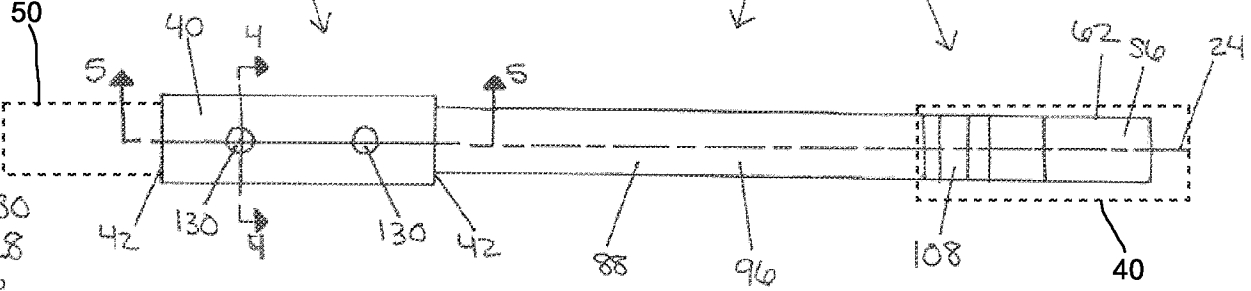
FIG. 3 is a bottom view of the exemplary embodiment of the tool with dashed lines used to indicate an alternate embodiment where the floating member is reciprocably connected to the head and fixed to the handle.
Figure 4:
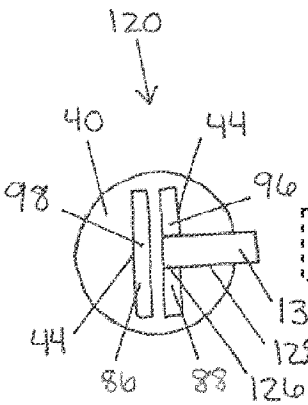
FIG. 4 is a transverse section view of a handle in the exemplary embodiment of the tool, taken along line 4-4 of FIG. 3.
Figure 5:
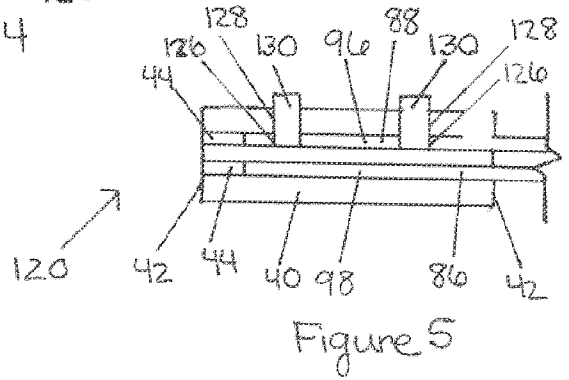
FIG. 5 is a longitudinal section view of the handle in the exemplary embodiment of the tool, taken along line 5-5 of FIG. 3.
Figure 6:
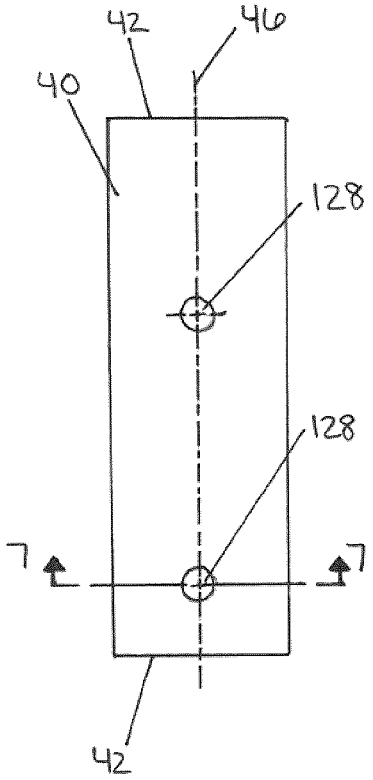
FIG. 6 is a bottom view of the handle in the exemplary embodiment of the tool.
Figure 7:
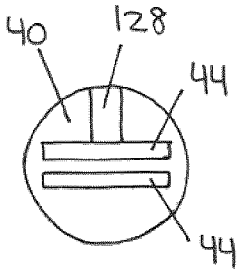
FIG. 7 is a transverse section view of the handle in the exemplary embodiment of the tool, taken along line 7-7 of FIG. 6.
Figure 8:
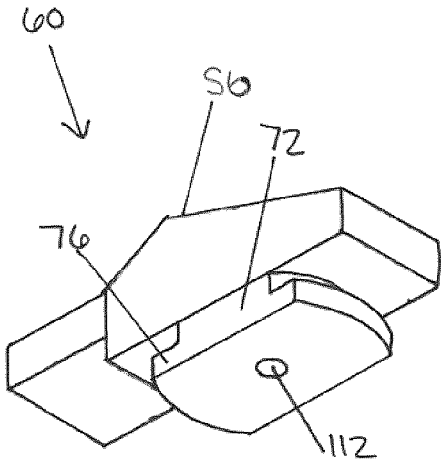
FIG. 8 is a pictorial view of a first head component in the exemplary embodiment of the tool.
Figure 9:
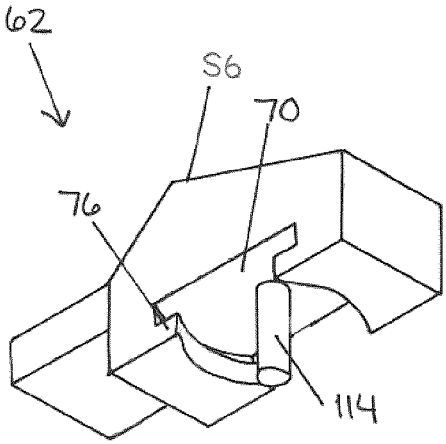
FIG. 9 is a pictorial view of a second head component in the exemplary embodiment of the tool.
Figure 10:
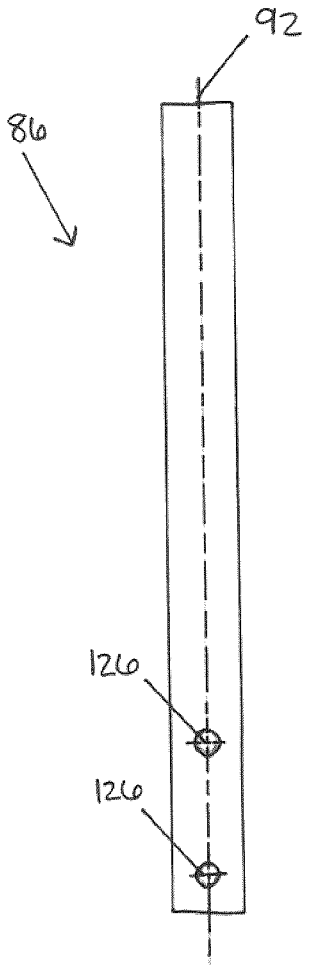
FIG. 10 is a top view of a first shaft member in the exemplary embodiment of the tool.
Figure 11:
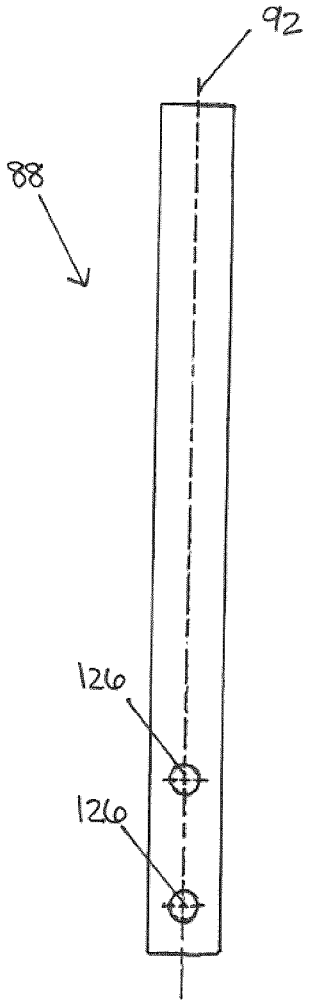
FIG. 11 is a top view of a second shaft member in the exemplary embodiment of the tool.

In the exemplary embodiment, the shaft (80) comprises two shaft members: a first shaft member (86) and a second shaft member (88). In other embodiments, the shaft (80) may comprise more than two shaft members. As depicted in FIGS. 1-3, the second shaft member (88) is a fixed shaft member (96) and the first shaft member (86) is a floating shaft member (98).

Therefore, as depicted in FIGS. 1-3, the second shaft member (88) is fixedly connected with both the handle (40) and the second head component (60) and the first shaft member (86) is reciprocably connected with at least one of the handle (40) or the first head component (62). In other embodiments, the first shaft member (86) may be a fixed shaft member (96) and the second shaft member (88) may be a floating shaft member (98). A floating shaft member (98) increases the overall strength of the shaft (80) without significantly decreasing the flexibility of the shaft (80).

In the exemplary embodiment, the shaft members (86, 88) consist or consist essentially of a suitable resilient material. In the exemplary embodiment, the resilient material is spring steel. Further, in the exemplary embodiment each shaft member (86, 88) is consists essentially of a single elongated length of spring steel with a rectangular cross-section which is relatively wide and relatively thin. Flexibility is achieved in the shaft members (86, 88) through a combination of their length and cross-section and the material properties of the spring steel. The cross-section of the shaft members (86, 88) also provides a width to length ratio sufficiently high for flexibility in only the tool swinging plane (28). Restricting flexibility in the shaft members (86, 88) to one plane prevents the tool (20) from bending off-center of its target, thereby potentially increasing the user's accuracy when swinging the tool (20).

The shaft (80) has an amount of flexibility in the tool swinging plane (28). In the exemplary embodiment, the amount of flexibility of the shaft (80) is variable. In the exemplary embodiment, changing the amount of flexibility of the shaft (80) may be achieved by varying the position of the handle (40) relative to the shaft members (86, 88) along the longitudinal tool axis (24), known as a longitudinal handle position.

In the exemplary embodiment, the handle (40) is generally smooth and cylindrical. Both ends of the cylindrical handle (40) have a base (42). In the exemplary embodiment, the handle (40) defines two longitudinal openings (44) which extend longitudinally through the handle (40) between the bases (42) and along a longitudinal handle axis (46). The openings (44) are each shaped as rectangular slots to receive one of the shaft members (86, 88). In the exemplary embodiment, the openings (44) extend longitudinally through the entire handle (40) in order to allow the handle (40) to slide along the shaft members (86, 88) to a suitable longitudinal handle position along the longitudinal tool axis (24).

In the exemplary embodiment, the tool (20) further comprises a nonpermanent handle fastening system (120) for connecting the handle (40) with the shaft members (86, 88). In the exemplary embodiment, the handle fastening system (120) provides a plurality of fastening positions for varying the longitudinal handle position along the longitudinal tool axis (24), in order to change the amount of flexibility in the shaft (80).

In the exemplary embodiment, the handle fastening system (120) comprises two slots (126) defined in each of the shaft members (86, 88), two bores (128) in the handle (40), and two pins (130) for inserting in the bores (128) and for engaging the slots (126). However, in other embodiments, the handle fastening system (120) may comprise any suitable plurality of slots (126), bores (128), and pins (130).

In the exemplary embodiment, the two bores (128) both extend through only one of the two openings (44) in the handle (40), such that only one shaft member (86, 88) may be fixedly connected with the handle (40) at a time, since the pins (130) are only able to engage the slots (126) in one of the shaft members (86, 88). Each slot (126) has a different longitudinal slot position along a longitudinal shaft axis (92), and each bore (128) has a different longitudinal bore position along the longitudinal handle axis (46). In the exemplary embodiment, the slots (126), the bores (128), and the pins (130) are cylindrical in shape and are configured to fit together.

As depicted in FIGS. 1-3, the two pins (130) engage the two slots (126) in the fixed shaft member (96). Meanwhile, the floating shaft member (98) is allowed to translate reciprocably within its corresponding opening (44) in the handle (40) as the shaft (80) flexes during the swinging of the tool (20). In other configurations, a single slot (126) defined in the fixed shaft member (96) may be engaged by only one pin (130).

In other embodiments, the handle fastening system (120) of the exemplary embodiment may be used in whole or part for the head fastening system (122) and the head fastening system (122) of the exemplary embodiment may be used in whole or part for the handle fastening system (120).

In the exemplary embodiment, the tool (20) is separable into a first sub-tool (36) and a second sub-tool (38), wherein the first sub-tool (36) comprises the first head component (60) fixedly connected to the first shaft member (86), and the second sub-tool (38) comprises the second head component (62) fixedly connected to the second shaft member (88). Each sub-tool (36, 38) comprises one of the head components (60, 62) in order for both sub-tools (36, 38) to be usable separately as hammers.

Figure 12:
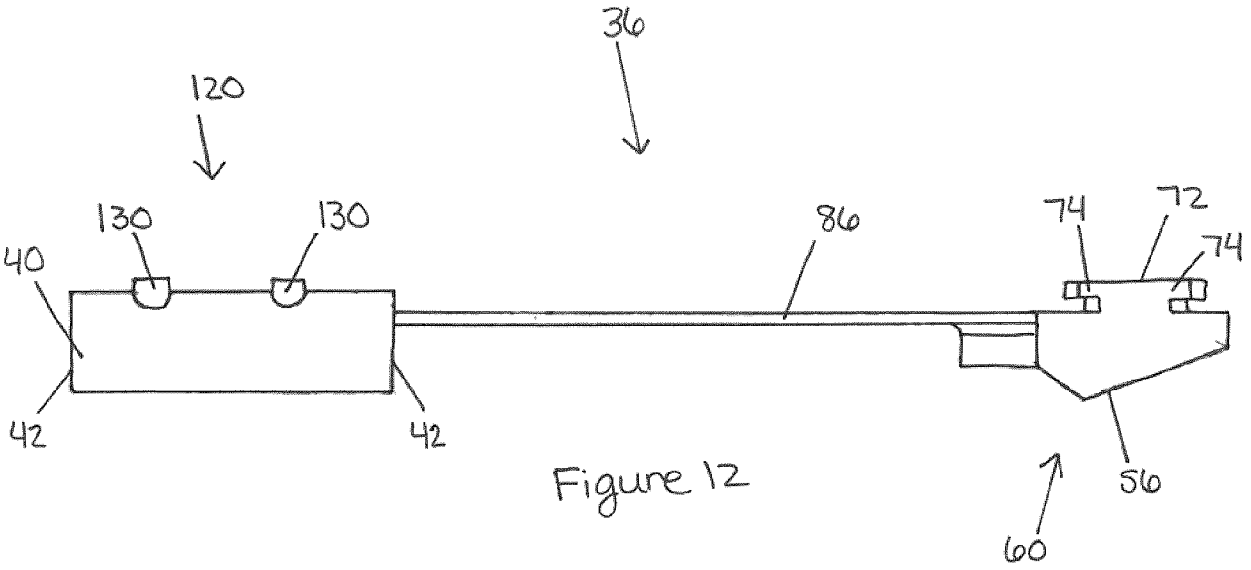
FIG. 12 is a side view of a first sub-tool in the exemplary embodiment of the tool.
Figure 13:
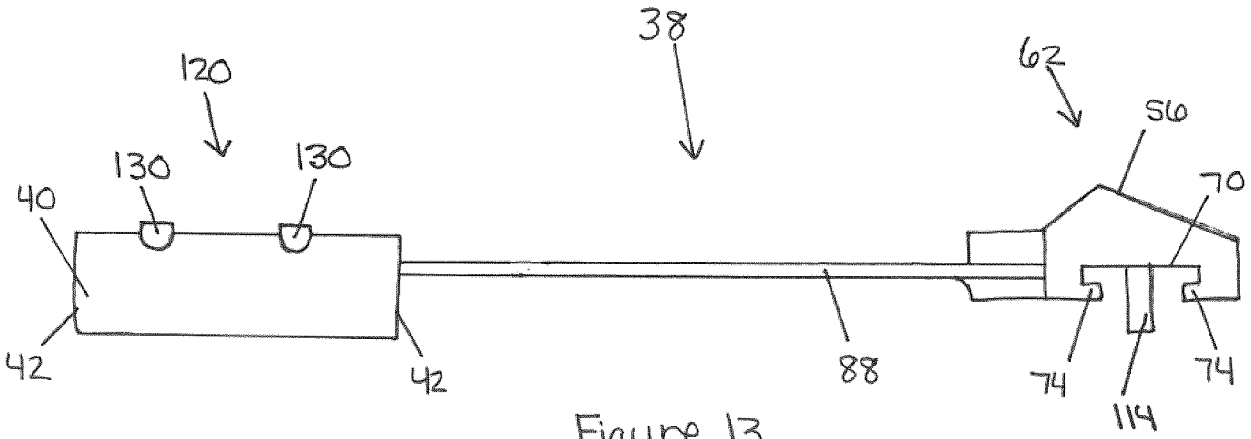
FIG. 13 is a side view of a second sub-tool in the exemplary embodiment of the tool.

In the exemplary embodiment, the tool (20) is separable into the sub-tools (36, 38) by removing the handle (40) from the shaft members (86, 88) and separating the head components (60, 62). As depicted in FIGS. 12 and 13, the sub-tools (36, 38) further comprise the handle (40), fixedly fastened by the handle fastening system (120) to the shaft member (86, 88) of either one of the sub-tools (36, 38). The flexibility of the shaft member (86, 88) may still be varied by varying the longitudinal handle position. However, in some configurations the sub-tools (36, 38) may be used without the handle (40).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

I claim:

1. A tool comprising:

(a) a handle;

(b) a head; and (c) a flexible shaft comprising a plurality of flexible shaft members each connecting the handle with the head, wherein:

the plurality of flexible shaft members comprises at least one fixed shaft member and at least one floating shaft member, each made with resilient material, each of the at least one fixed shaft member is fixedly connected with both the handle and the head, and each of the at least one floating shaft member having a first end that is fixedly connected with one of the handle and the head, and a second end that is reciprocably connected with the other of the one of the handle and the head, with the second end of the at least one floating shaft member disposed part way in an opening that extends longitudinally through the one of the handle and the head to permit the at least one floating shaft member to translate reciprocably forward and backward within the opening as the flexible shaft, when under a tool swinging force during swinging of the tool, flexes in a tool swinging plane from an original, unbent position, to a bent position, and the resilient material of the flexible shaft is structured to spring the flexible shaft back to the original, unbent position in the absence of the tool swinging force.

2. The tool of claim 1, wherein the head comprises a tool structure.

3. The tool of claim 2, wherein the tool is a hammer, and wherein the tool structure comprises a striking face.

4. The tool of claim 1, wherein the head comprises a plurality of head components.

5. The tool of claim 4, wherein:

the head comprises two head components, and wherein the head components are separable;

each head component comprises a tool structure;

at least one of the tool structures comprises a striking face; and the tool has a longitudinal tool axis, and wherein at least one striking face is oblique to the longitudinal tool axis.

6. The tool of claim 5, further comprising a connection mechanism for connecting the head components and wherein:

each of the head components comprises at least one connecting flange, wherein the connecting flanges interlock to connect the head components, and wherein the connection mechanism comprises the connecting flanges; and one of the head components defines a cavity, wherein the other of the head components comprises a protrusion, wherein the protrusion is received within the cavity, and wherein the connection mechanism comprises the cavity and the protrusion.

7. The tool of claim 5, wherein the tool comprises two flexible shaft members, wherein one of the flexible shaft members is fixedly connected to one of the head components, and wherein the other of the flexible shaft members is fixedly connected to the other of the head components.

8. The tool of claim 1, wherein the flexible shaft is flexible only in the tool swinging plane.

9. The tool of claim 8, wherein the flexible shaft has an amount of flexibility in the tool swinging plane, and wherein the amount of flexibility is variable.

10. The tool of claim 9, wherein the handle has a longitudinal handle position along the shaft, and wherein the longitudinal handle position is variable to change the amount of flexibility of the shaft.

11. The tool of claim 1, wherein the flexibility of the shaft is provided by the resilient material.

12. The tool of claim 11, wherein the resilient material is provided as a single piece of resilient material.

13. The tool of claim 12, wherein each of the flexible shaft members consists essentially of the resilient material.

14. The tool of claim 1, wherein the tool further comprises a handle fastening system for reciprocably connecting the at least one floating shaft member with the handle.

15. The tool of claim 14, wherein the handle fastening system comprises a slot defined in the at least one floating shaft member, a bore defined by the handle, and a pin for inserting in the bore and for engaging the slot in order to connect the at least one floating shaft member with the handle.

16. The tool of claim 14, wherein the handle has a longitudinal handle position along the flexible shaft, wherein the longitudinal handle position is variable, and wherein the handle fastening system provides a plurality of fastening positions of the handle relative to the flexible shaft for varying the longitudinal handle position.

17. The tool of claim 16, wherein the handle fastening system comprises a slot defined in at least one of the flexible shaft members, a bore defined by the handle, and a pin for inserting in the bore and engaging the slot in order to fixedly connect at least one of the flexible shaft members with the handle.

18. The tool of claim 17, wherein at least one of the flexible shaft members defines a plurality of slots at different longitudinal slot positions along the shaft member.

19. The tool of claim 17, wherein the handle defines a plurality of bores at different longitudinal bore positions along the handle.

20. The tool of claim 1, wherein:

the tool further comprises a head fastening system for fixedly connecting the head with the at least one floating shaft member; and the head fastening system comprises a weld between the head and the at least one floating shaft member.

21. The tool of claim 1 wherein the opening extends longitudinally partially through the one of the handle and the head.

* * * * *